US008011061B2

(12) United States Patent
Yoo

(10) Patent No.: US 8,011,061 B2
(45) Date of Patent: Sep. 6, 2011

(54) NOZZLE ASSEMBLY OF VACUUM CLEANER

(75) Inventor: Dong-Hun Yoo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 1180 days.

(21) Appl. No.: 11/787,009

(22) Filed: Apr. 13, 2007

(65) Prior Publication Data

US 2008/0086831 A1 Apr. 17, 2008

Related U.S. Application Data

(60) Provisional application No. 60/850,737, filed on Oct. 11, 2006.

(30) Foreign Application Priority Data

Dec. 15, 2006 (KR) ..... 10-2006-0128547

(51) Int. Cl.
*A47L 5/00* (2006.01)

(52) U.S. Cl. ..... 15/364; 15/367; 15/368; 15/380; 15/383; 15/393; 15/401

(58) Field of Classification Search ..... 15/365, 15/367, 368, 373, 380, 383, 393, 401, 402, 15/364; *A47L 5/00*
See application file for complete search history.

(56) References Cited

U.S. PATENT DOCUMENTS

| | | | | |
|---|---|---|---|---|
| 6,325,864 | B1 | 12/2001 | Zahuranec et al. | 134/21 |
| 7,631,395 | B2 * | 12/2009 | Oh | 15/355 |
| 2007/0143954 | A1 * | 6/2007 | Graham et al. | 15/364 |
| 2008/0086838 | A1 * | 4/2008 | Yoo et al. | 15/415.1 |

FOREIGN PATENT DOCUMENTS

JP 07163495 6/1995

* cited by examiner

*Primary Examiner* — David A Redding
(74) *Attorney, Agent, or Firm* — Ohlandt, Greeley, Ruggiero & Perle, LLP

(57) ABSTRACT

A nozzle assembly of a vacuum cleaner is disclosed. The A nozzle assembly includes a main casing having an air inlet formed thereto to draw in dust or dirt from a surface to be cleaned, a drum brush disposed in the main casing to brush away the dust or dirt adhered to the surface while rotating in contact with the surface, and a subsidiary brush unit disposed in front of the main casing to preliminarily brush away the dust or dirt adhered to the surface in front of the drum brush, and having a cover disposed in front of the main casing, and a subsidiary brush member to come in elastic contact with the surface. The subsidiary brush member is configured to change a relative position to the cover, and thus to selectively maintain a contact state or a non-contact state to the surface.

10 Claims, 6 Drawing Sheets

NOZZLE ASSEMBLY OF VACUUM CLEANER

CROSS-REFERENCE TO RELATED APPLICATIONS

This application claims the benefit under 35 U.S.C. §119 (e) of U.S. Provisional Patent Application No. 60/850,737, filed Oct. 11, 2006, in the United States Patent and Trademark Office, and claims the benefit under 35 U.S.C. §119(a) Korean Patent Application No. 10-2006-0128547, filed on Dec. 15, 2006, in the Korean Intellectual Property Office, the entire contents of both of which are hereby incorporated by reference.

BACKGROUND OF THE INVENTION

1. Field of the Invention

The present disclosure relates to a vacuum cleaner. More particularly, the present disclosure relates to a nozzle assembly of a vacuum cleaner having a subsidiary brush.

2. Description of the Related Art

In general, a vacuum cleaner is provided with a nozzle assembly capable of drawing in dust or dirt from a surface to be cleaned. Such a nozzle assembly is an apparatus, which draws in the dirt or the dust from the surface to be cleaned by a suction force generated from a suction motor mounted in a cleaner body in a state where it comes in contact with the surface to be cleaned.

However, among such conventional nozzle assemblies, a nozzle assembly, which is applied to an upright vacuum cleaner, is rotatably joined to the cleaner body, and has a drum brush installed inside of an air let thereof to scrape against the surface to be cleaned and, thus, to efficiently brush the dust or dirt therefrom. Accordingly, if the drum brush is rotated, the dust or dirt stained to the surface to be cleaned can be efficiently separated therefrom and drawn into the cleaner body.

However, if the surface to be cleaned, particularly, a surface of carpet is cleaned by the nozzle assembly having the drum brush, the dirt, such as hair, fur of a pet, or the like, which is firmly stuck to the surface to be cleaned is not removed well. Particularly, if fibers of the carpet are tangled with the hair or fur, it is difficult to separate the hair or fur from the carpet.

SUMMARY OF THE INVENTION

An aspect of the present disclosure is to address at least the above problems and/or disadvantages and to provide at least the advantages described below. Accordingly, an aspect of the present disclosure is to provide a nozzle assembly of a vacuum cleaner having a subsidiary brush, which scrapes against dust or dirt, such as hair, fur of a pet, or the like, tangled and adhered to a surface to be cleaned, thereby efficiently cleaning the dust or dirt.

Another aspect of the present disclosure is to provide a nozzle assembly of a vacuum cleaner having a subsidiary brush capable of adjusting a height thereof.

In accordance with an aspect of the present disclosure, a nozzle assembly of a vacuum cleaner includes a main casing having an air inlet formed thereto to draw in dust or dirt from a surface to be cleaned, a drum brush disposed in the main casing to brush away the dust or dirt adhered to the surface to be cleaned while rotating in contact with the surface to be cleaned, and a subsidiary brush unit disposed in front of the main casing to preliminarily brush away the dust or dirt adhered to the surface to be cleaned in front of the drum brush, and having a cover disposed in front of the main casing, and a subsidiary brush member to come in elastic contact with the surface to be cleaned. The subsidiary brush member is configured to change a relative position to the cover, and thus to selectively maintain a contact state or a non-contact state to the surface to be cleaned.

The subsidiary brush unit may be configured to further include a fixing panel to which the subsidiary brush member is connected, and a height adjusting part to move the fixing panel in an up-and-down direction so as to adjust a height of the subsidiary brush member.

Preferably, but not necessarily, the height adjusting part includes at least one inclined rail disposed on an upper surface of the fixing panel and having a plurality of fixing projections, a handle having one side exposed to the outside of the cover and the other side having at least one locking projection formed thereon, and a fixing part having at least one projecting hook slidably joined with the inclined rail, and an extended tube to lock the locking projection.

Preferably, but not necessarily, the subsidiary brush member includes a subsidiary brush casing rotatably disposed to the fixing panel, and a subsidiary brush joined to the subsidiary brush casing, and the subsidiary brush is detachably joined to the subsidiary brush casing.

Preferably, but not necessarily, the subsidiary brush includes a plurality of protrusions projected from a surface thereof facing the surface to be cleaned.

Preferably, but not necessarily, the cover is detachably mounted to the main casing.

Preferably, but not necessarily, the subsidiary brush member is disposed to be rotatable to the fixing panel.

BRIEF DESCRIPTION OF THE DRAWING FIGURES

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a nozzle assembly 100 of a vacuum cleaner according to an exemplary embodiment of the present disclosure will be described in detail with reference to the accompanying drawing figures.

Figure 1:
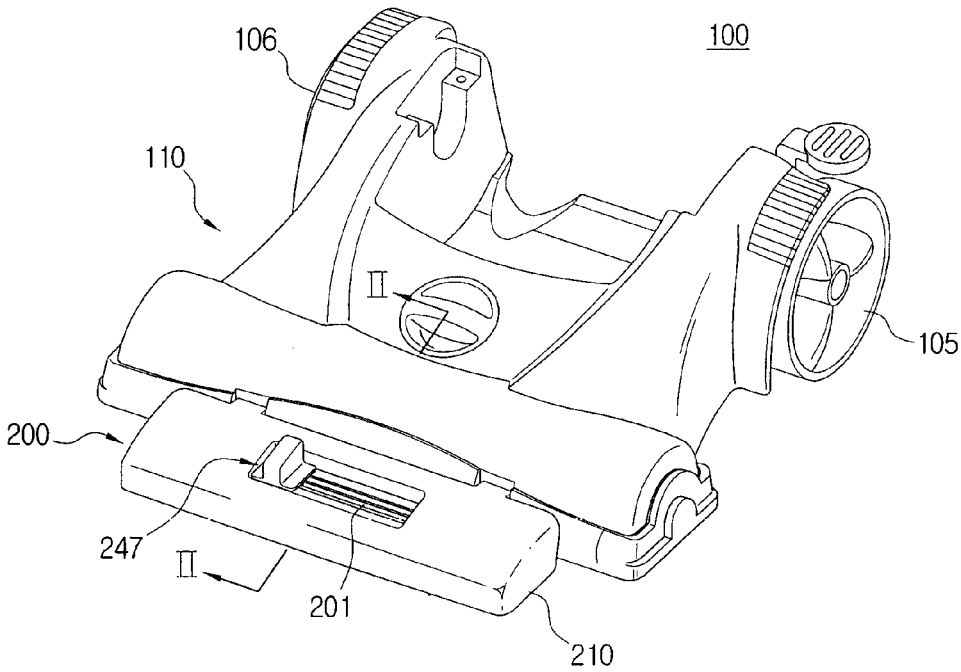
FIG. 1 is a perspective view exemplifying a nozzle assembly of a vacuum cleaner according to an exemplary embodiment of the present disclosure.
Figure 2:
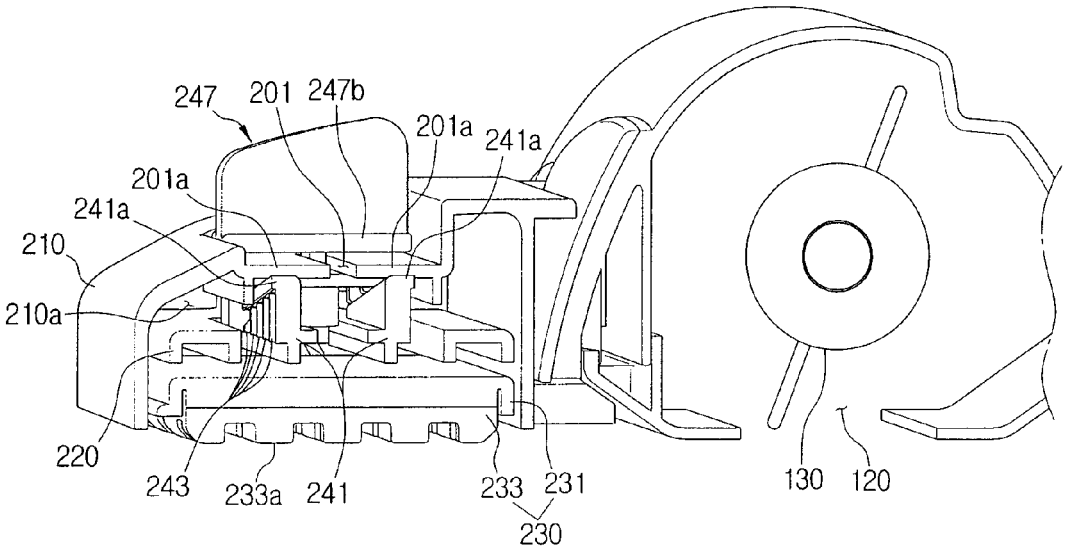
FIG. 2 is a cross-sectional view taken along line II-II in FIG. 1.
Figure 3:
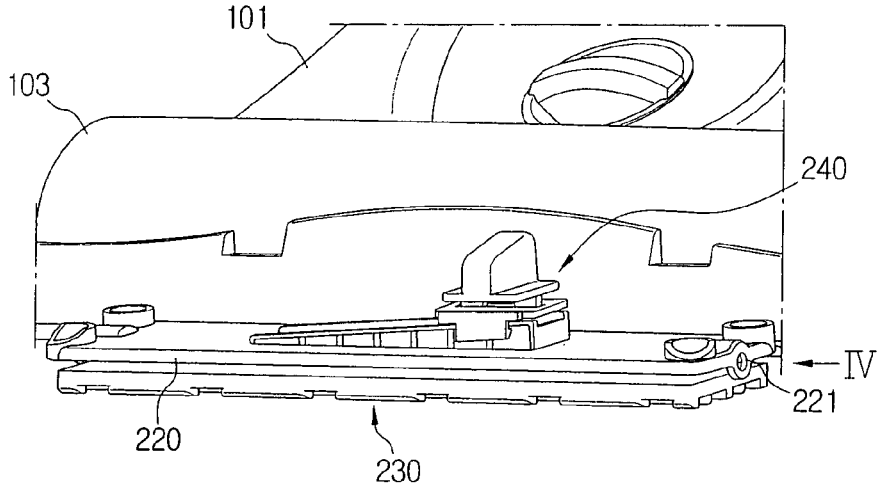
FIG. 3 is a perspective view exemplifying a portion of a subsidiary brush unit of the nozzle assembly illustrated in FIG. 1 from which a cover is removed.

Referring to FIGS. 1 and 2, the nozzle assembly 100 according to the exemplary embodiment of the present disclosure includes a main casing 110, a drum brush 130 and a subsidiary brush unit 200.

The main casing 110 draws in external air laden with dust or dirt into a cleaner body (not illustrated) from a surface to be cleaned. For this, the main casing 110 at an undersurface thereof has a dust inlet 120 and at the rear thereof is connected with the cleaner body. When a vacuum source (not illustrated) mounted in the cleaner body generates a suction force, the dust or dirt is drawn in through the dust inlet 120 of the main casing 110. At this time, to easily move the nozzle assembly 100, a pair of wheels 105 and 106 is installed in the rear of the main casing 110.

The drum brush 130 brushes away the dust or dirt adhered to the surface to be cleaned while rotating in contact with the surface to be cleaned. For this, the drum brush 130 is rotatably disposed inside of the dust inlet 120 of the main casing 10.

The subsidiary brush unit 200 is fixedly installed in front of the main casing 110, so that the subsidiary brush unit preliminary brushes away the dust or dirt adhered to the surface to be cleaned in front of the drum brush 130.

Referring to FIGS. 1 through 5, the subsidiary brush unit 200 includes a cover 210, a fixing panel 220, a subsidiary brush member 230, and a height adjusting part 240.

As illustrated in FIG. 2, the cover 210 has a space 210*a* formed therein to accommodate the fixing panel 220, the subsidiary brush member 230, and the height adjusting part 240. A rear end of the cover 210 is fixed in front of the main casing 110. Alternatively, the cover 210 can be detachably connected to the main casing 110. Also, a guide hole 201 having a certain length is formed along a width direction of the cover 210 on an upper surface thereof.

The fixing panel 220 is fixedly installed in a state approximately parallel to the cover 210 in the space 210*a* of the cover 210. Hinge holes 221 (see FIGS. 4 and 5) are formed on both side ends of the fixing panel 220, respectively.

The subsidiary brush member 230 scrapes against the surface to be cleaned, particularly, a carpet or the like, to separate the dust or dirt, particularly, hair or fur of a pet adhered thereto, and includes a subsidiary brush casing 231 and a subsidiary brush 233.

As illustrated in FIG. 2, the subsidiary brush casing 231 is formed to have an approximately rectangular cross section. The subsidiary brush casing 231 can be formed in various shapes or materials according to the object of the use. Also, the subsidiary brush casing 231 has hinge projections 231*a* (see FIGS. 4 and 5) hinged to the hinge holes 221 of the fixing panel 220, respectively.

Figure 9:
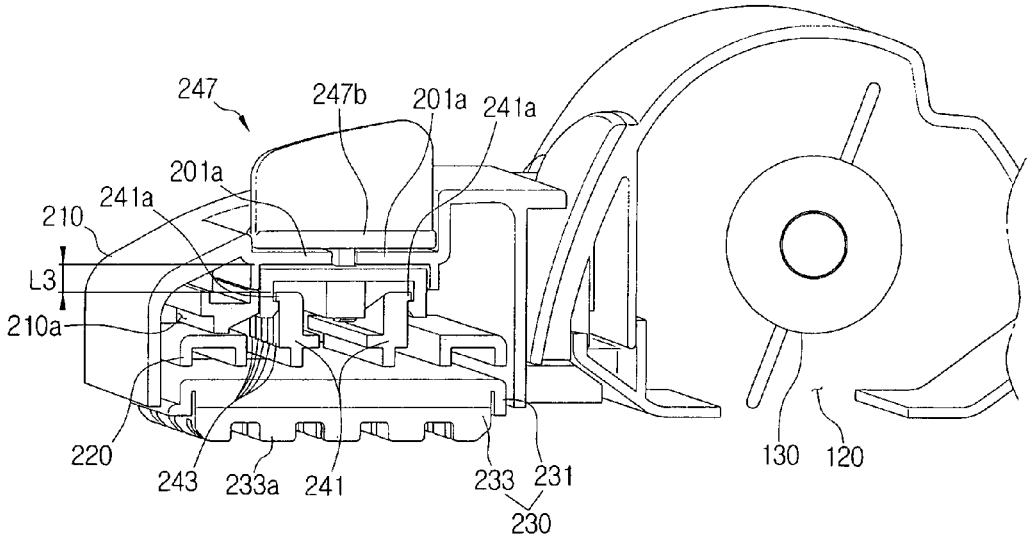
FIG. 9 is a cross-section view taken along line IX-IX in FIG. 8.
Figure 10:
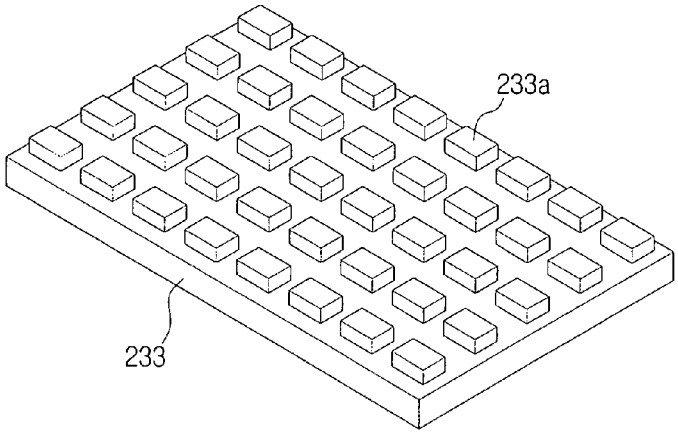
FIG. 10 is a view exemplifying a subsidiary brush of the subsidiary brush unit of the nozzle assembly according to the exemplary embodiment of the present disclosure.
Figure 11:
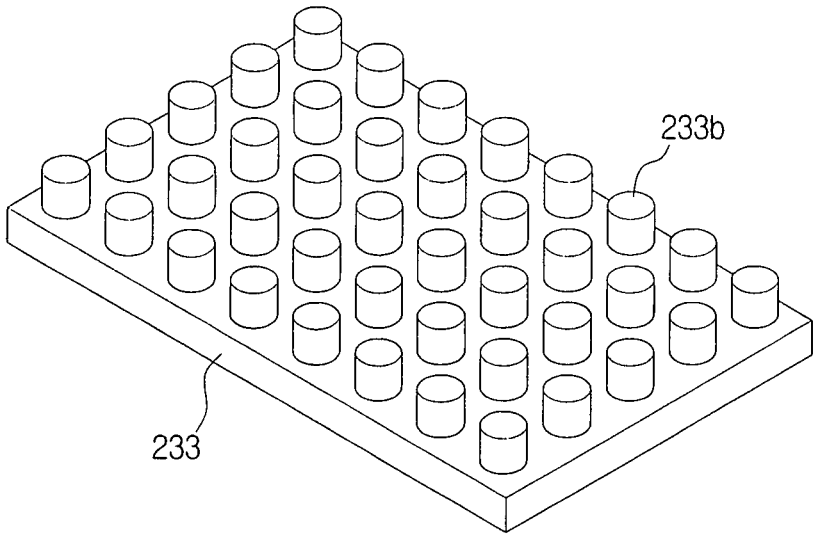
FIG. 11 is a view exemplifying another example of the subsidiary brush of the subsidiary brush unit.
Figure 12:
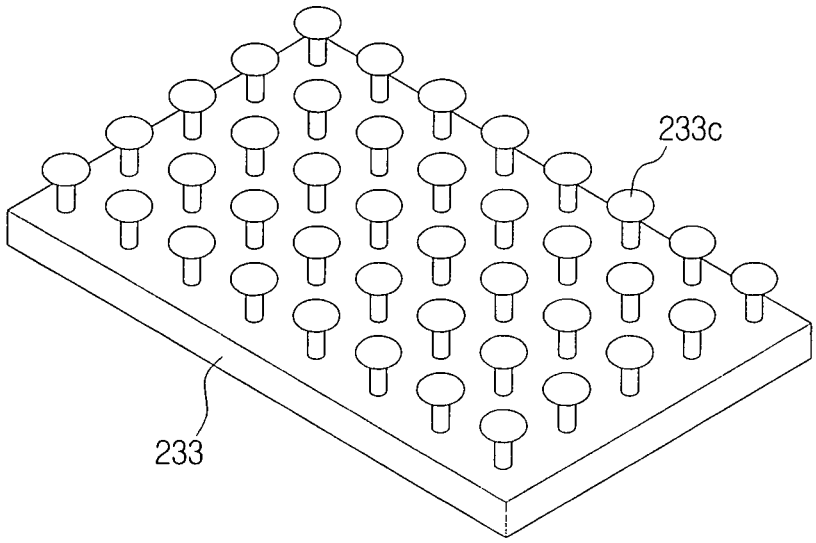
FIG. 12 is a view exemplifying still another example of the subsidiary brush of the subsidiary brush unit.

The subsidiary brush 233 is joined to an undersurface of the subsidiary brush casing 231, and has a plurality of projections 233*a* formed on an undersurface thereof, so that the projections can scrape against the carpet or the like to separate the hair or fur adhered thereto. As illustrated in FIGS. 9 and 10, each of the plurality of projections 233*a* is formed in a rectangular parallelepiped shape, and projected toward the surface to be cleaned from the subsidiary brush 233. Alternatively, instead of the rectangular parallelepiped shape as illustrated in FIG. 10, each of the plurality of the projections can be formed in a cylinder shape 233*b* as illustrated in FIG. 11, or a sphere shape 233*c*, which is configured, so that an end tip coming in contact with the surface to be cleaned is supported on a cylinder projected from the subsidiary brush 233 and rounded to have a diameter larger than that of the cylinder, as illustrated in FIG. 12. Also, in the exemplary embodiment of the present disclosure, the subsidiary brush 233 and the projections 233*a* are formed of a rubber having elasticity. The subsidiary brush 233 is detachably joined to the undersurface of the subsidiary brush casing 231. Accordingly, in maintenance, since only the subsidiary brush 233 stained with the dust or dirt after use can be separated from the subsidiary brush casing 231 and cleaned, it is easy to maintain and repair the subsidiary brush 233.

The height adjusting part 240 connects the fixing panel 220 and the cover 210, so that the height adjusting part can adjust a height of the subsidiary brush member 230 and, thus, allow the subsidiary brush member 230 to be maintained in contact or non-contact with the surface to be cleaned. For this, the height adjusting part 240 includes a pair of inclined rails 241, a fixing part 245 and a handle 247.

The pair of inclined rails 241 is fixedly installed in a parallel spaced-apart relation to each other along a width direction of the fixing panel 220 on an upper surface thereof. Also, the pair of inclined rails 241 is inclined from one sides to the other sides thereof, and at outer surfaces of lower parts thereof has a plurality of fixing projections 243 formed in a spaced-apart relation to one another, respectively.

Figure 6:
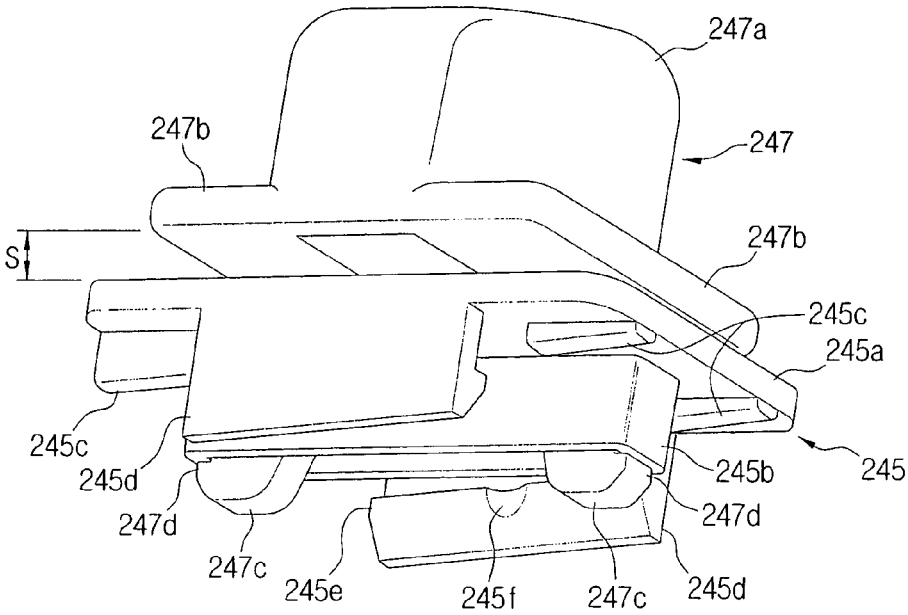
FIG. 6 is a perspective view exemplifying a handle and a fixing part of a height adjusting part of the subsidiary brush unit illustrated in FIG. 5, which are combined with each other.

As illustrated in FIG. 6, the fixing part 245 is provided with a plate 245*a* having a certain area. An extended tube 245*b* having a penetrated hole formed to penetrate the plate 245*a* is extended downward from the plate 245*a*. A pair of extended pieces 245*d* is extended downward in a right angle with respect to the plate 245*a* from both sides thereof, and has projecting hooks 245*e* projected in an inward direction from lower ends thereof, respectively, as illustrated in FIG. 6. Such a pair of projecting hooks 245*e* is slidably joined to inclined rail projections 241*a* (see FIG. 2) formed on the outsides of upper parts of the inclined rails 241. On the pair of projecting hooks 245*e* are formed fixing grooves 245*f* into which the plurality of fixing projections 243 (see FIG. 5) formed on the pair of inclined rails 241 are snapped and fixed, respectively.

Also, inclined projections 245*c* inclined downward in alternate angles to an inclined angle of the inclined rails 241 are formed at positions corresponding the inclined rails 241 on an undersurface of the plate 245*a*. With the inclined projections 245*c*, the plate 245*a* is slid and moved in a state parallel to the fixing panel 220.

Figure 7:
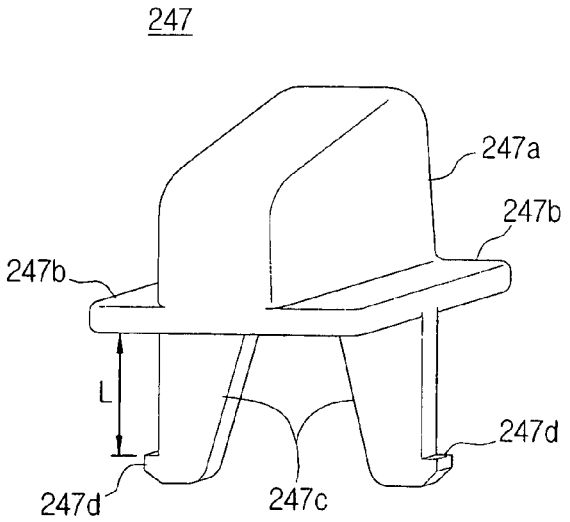
FIG. 7 is a perspective view exemplifying the handle illustrated in FIG. 6.

As illustrated in FIG. 7, the handle 247 has a knob 247*a* projected out of the cover 110 (see FIG. 1). A pair of extended parts 247*b* is formed in a direction approximately vertical to the knob 247*a* from both sides of a lower end thereof. A pair of locking projections 247*c* is extended downward in a direction vertical to the extended parts 247*b* from undersurfaces thereof, respectively, and at lower ends thereof has hanging hooks 247*d* projected in an outside direction, respectively. As the pair of locking projections 247*c* is inserted into the extended tube 245*b* of the plate 245*a*, the pair of hanging hooks 247*d* is snapped to a lower end of the extended tube 245*b*, so that the handle 247 is stably joined to the fixing part 245. In this case, preferably, but not necessarily, a length L of the pair of locking projections 247*c* is set, so that when the fixing part 245 and the handle 247 are joined to each other, a predetermined gap S is formed therebetween, as illustrated in FIG. 6. According to this, an inner circumferential part 201*a* (see FIG. 2) of the guide hole 201 can be inserted into a space formed by the gap S in a state that the fixing part 245 and the handle 247 are joined to each other, and the fixing part 245 can be also smoothly slid and moved along with the handle 247 when the handle 247 is moved along the guide hole 201 (see FIG. 1) with grasped by a user.

Hereinafter, an operation of the subsidiary brush unit 200 of the nozzle assembly 100 according to the exemplary embodiment of the present disclosure constructed as described above will now be explained with reference to the accompanying drawing figures.

Figure 8:
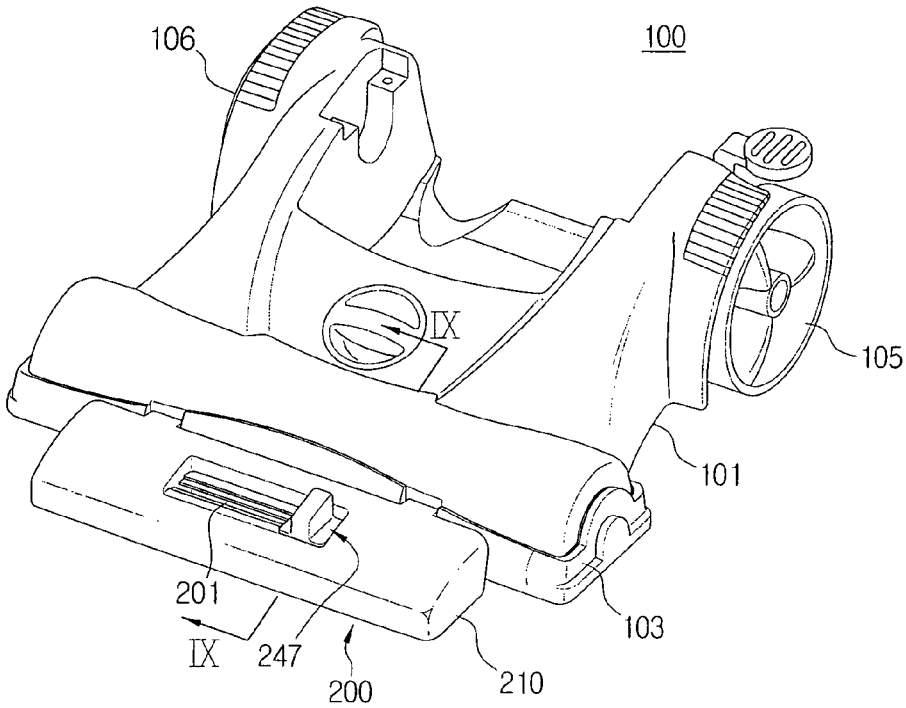
FIG. 8 is a perspective view exemplifying the nozzle assembly when the handle is moved right along a guide hole.

First, assuming that to clean hair or fur of a pet deeply stuck into a carpet, a user wants to position the subsidiary brush member 230 to a lowest position, as illustrated in FIGS. 8 and 9, she or he grasps the knob 247*a* of the handle 247 located at one side of the guide hole 201, and then moves the knob to a rightmost position of the guide hole 201 along the guide hole 201.

When the handle 247 is moved as described above, as illustrated in FIG. 9, the fixing part 245 joined with the handle 247 is moved in the same direction as that of the handle 247, and at the same time, is slid and moved right along the pair of the inclined rails 241 because the projecting hooks 245*e* of the fixing part 245 and the projecting parts 241*a* of the inclined rails 241 are slidably joined to each other. In this case, the cover 210 is fixedly installed and the handle 247 can be moved only left and right in the same height along the guide hole 201. Accordingly, the more the handle 247 is moved right (the right in FIG. 3), the more a distance between the inclined rails 241 and the fixing panel 220 is increased. Thus, the fixing panel 220 on which the inclined rails 241 are fixedly installed is moved downward, and thereby the subsidiary brush member 230 hinged to the fixing panel 220 is moved downward by a height L2 (see FIG. 5).

In addition, while the handle 247 is moved, the plurality of fixing projections 243 of the inclined rails 241 repeats to snap to and separate from the fixing grooves 245*f* of the fixing part 245. Accordingly, after lowering the subsidiary brush member 230 to the lowest position to allow the subsidiary brush member to deeply infiltrate into the carpet, the user can maintain the subsidiary brush member 230 in a stably fixed state by snapping two fixing projections 243 located at the rightmost position to the fixing grooves 245*f*.

If the user does not want to use the subsidiary brush member 230, as illustrated in FIG. 1, she or he moves the handle 247 to a leftmost position (the left in FIG. 1). As a result, the subsidiary brush member 230 is positioned to a highest position by an operation opposite to the operation of positioning it to the lowest position as described above, so that it does not come in contact with the surface to be cleaned, that is, the carpet. In this case, after lifting the subsidiary brush member 230 to the highest position to allow it not to come in contact with the carpet, the user can maintain the subsidiary brush member 230 in a stably fixed state by snapping two fixing projections 243 located at the leftmost position to the fixing grooves 245*f*.

The nozzle assembly 100 according to the exemplary embodiment of the present disclosure allows the user to adjust the height of the subsidiary brush member 230 by manipulating the handle 247 and then snapping any two fixing projections 243 among the plurality of fixing projections 243 to the fixing grooves 245*f*. Accordingly, with the nozzle assembly 100 according to the exemplary embodiment of the present disclosure, the user can select the height of the subsidiary brush member 230 according to a use or a thickness of the carpet, thereby allowing the hair or fur stuck to the carpet to be easily removed.

When the handle 247 and the fixing part 245 are positioned to the leftmost position thus to maintain the subsidiary brush member 230 in the highest position, preferably, but not necessarily, a gap L3 (see FIG. 9) formed by upper sides of the guide rails 241 and an inner surface of the upper portion of the cover 210 is set equal to or larger than the height L2 (see FIG. 5), so that highest portions, that is, rightmost portions of the inclined rails 241 do not come in contact with the cover.

Figure 4:
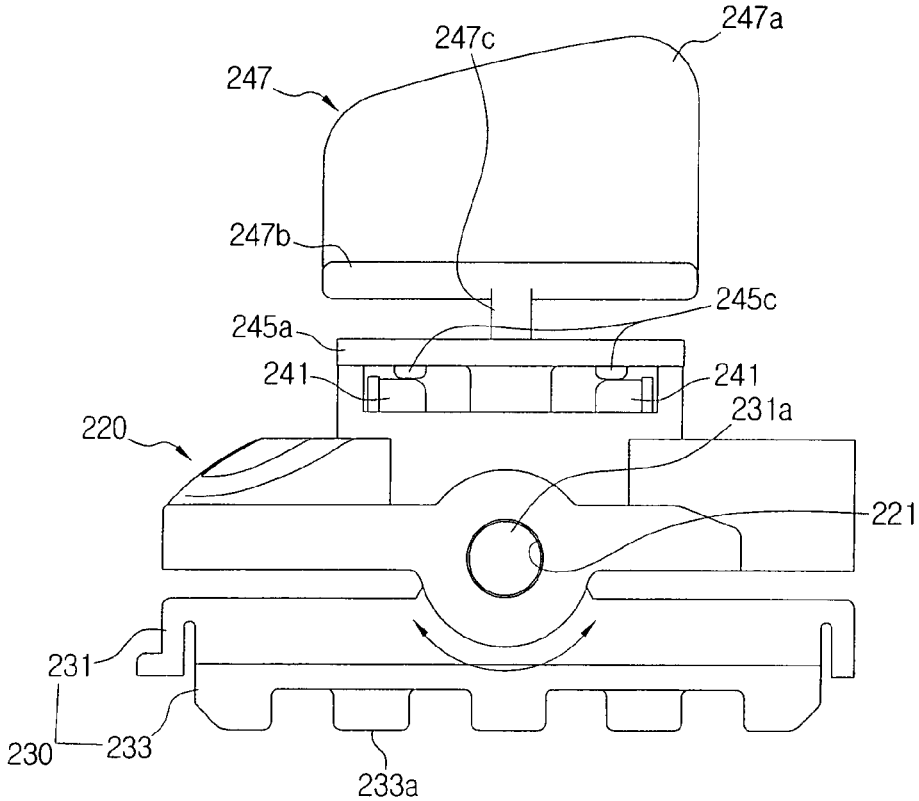
FIG. 4 is a side elevation view as viewed in a direction IV in FIG. 3.
Figure 5:
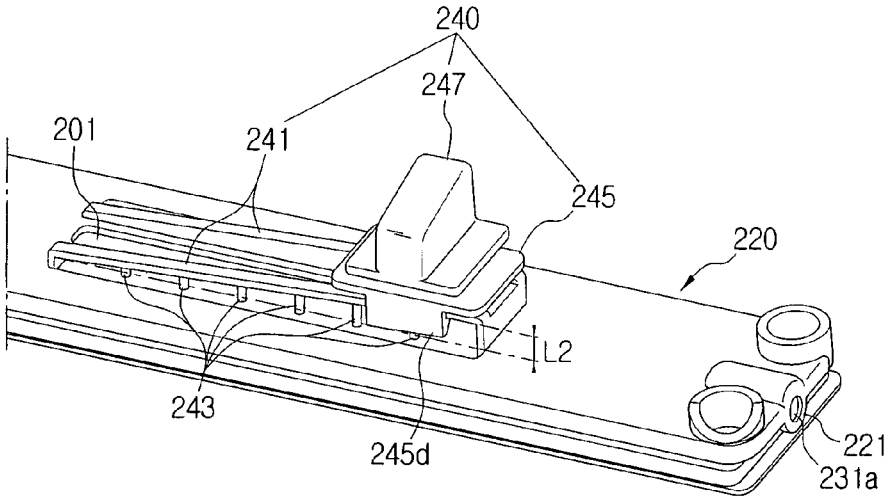
FIG. 5 is a partial perspective view exemplifying the subsidiary brush unit illustrated in FIG. 3 from which the cover is removed.

Also, if the user cleans the carpet after lowering the subsidiary brush member 230 to a position where she or he wants, the subsidiary brush 233, which comes in pressure contact with the carpet when the vacuum cleaner is moved forward and rearward, produces friction with the carpet, and, thus scrapes, against and separates the hair or fur tangled to the carpet. In this case, as illustrated in FIG. 4, the subsidiary brush member 230 is pivoted forward and rearward by a predetermined angle about the hinge projections 231*a*, thereby reducing operation resistance for the vacuum cleaner.

As apparent from the foregoing description, according to the exemplary embodiment of the present disclosure, the nozzle assembly of the vacuum cleaner has the subsidiary brush unit disposed at the one side of the main casing, so that the projections formed on the subsidiary brush of the subsidiary brush member scrapes against the hair or fur tangled to the carpet, thereby allowing the carpet to more efficiently clean.

Also, the nozzle assembly of the vacuum cleaner according to the exemplary embodiment of the present disclosure is configured, so that the height of the subsidiary brush member can be adjusted according to selection of the user, thereby allowing the subsidiary brush member to selectively come in contact or non-contact with the carpet.

Although representative exemplary embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A nozzle assembly of a vacuum cleaner, comprising:

a main casing having an air inlet formed thereto to draw in dust or dirt from a surface to be cleaned;

a drum brush disposed in the main casing to brush away the dust or dirt adhered to the surface to be cleaned while rotating in contact with the surface to be cleaned; and a subsidiary brush unit disposed in front of the main casing to preliminarily brush away the dust or dirt adhered to the surface to be cleaned in front of the drum brush, the subsidiary brush unit having a cover disposed in front of the main casing, and the subsidiary brush unit having a subsidiary brush member to come in elastic contact with the surface to be cleaned, wherein the subsidiary brush member is configured to change a relative position within the cover, and thus to selectively maintain a contact state or a non-contact state to the surface to be cleaned.

2. The nozzle assembly as claimed in claim 1, wherein the subsidiary brush unit further comprises:

a fixing panel to which the subsidiary brush member is connected; and a height adjusting part to move the fixing panel in an up-and-down direction so as to adjust a height of the subsidiary brush member.

3. The nozzle assembly as claimed in claim 2, wherein the height adjusting part comprises:

at least one inclined rail disposed on an upper surface of the fixing panel, the at least one inclined rail having a plurality of fixing projections;

a handle having one side exposed to the outside of the cover and the other side having at least one locking projection formed thereon; and a fixing part having at least one projecting hook slidably joined with the at least one inclined rail, and an extended tube to lock the at least one locking projection.

4. The nozzle assembly as claimed in claim 2, wherein the subsidiary brush member comprises:

a subsidiary brush casing rotatably disposed to the fixing panel; and a subsidiary brush joined to the subsidiary brush casing.

5. The nozzle assembly as claimed in claim 4, wherein the subsidiary brush is detachably joined to the subsidiary brush casing.

6. The nozzle assembly as claimed in claim 4, wherein the subsidiary brush comprises a plurality of protrusions projected from a surface thereof facing the surface to be cleaned.

7. The nozzle assembly as claimed in claim 1, wherein the cover is detachably mounted to the main casing.

8. The nozzle assembly as claimed in claim 2, wherein the subsidiary brush member is disposed to be rotatable to the fixing panel.

9. A nozzle assembly of a vacuum cleaner, comprising:

a main casing having an air inlet formed thereto to draw in dust or dirt from a surface to be cleaned;

a drum brush disposed in the main casing to brush away the dust or dirt adhered to the surface to be cleaned while rotating in contact with the surface to be cleaned; and a subsidiary brush unit disposed in front of the main casing to preliminarily brush away the dust or dirt adhered to the surface to be cleaned in front of the drum brush, the subsidiary brush unit having a cover disposed in front of the main casing, and the subsidiary brush unit having a subsidiary brush member to come in elastic contact with the surface to be cleaned, wherein the subsidiary brush member is configured to change a relative position to the cover, and thus to selectively maintain a contact state or a non-contact state to the surface to be cleaned, wherein the subsidiary brush unit further comprises:

a fixing panel to which the subsidiary brush member is connected; and a height adjusting part to move the fixing panel in an up-and-down direction so as to adjust a height of the subsidiary brush member, and wherein the height adjusting part comprises:

at least one inclined rail disposed on an upper surface of the fixing panel, the at least one inclined rail having a plurality of fixing projections;

a handle having one side exposed to the outside of the cover and the other side having at least one locking projection formed thereon; and a fixing part having at least one projecting hook slidably joined with the at least one inclined rail, and an extended tube to lock the at least one locking projection.

10. A nozzle assembly of a vacuum cleaner, comprising:

a main casing having an air inlet formed thereto to draw in dust or dirt from a surface to be cleaned;

a drum brush disposed in the main casing to brush away the dust or dirt adhered to the surface to be cleaned while rotating in contact with the surface to be cleaned; and a subsidiary brush unit disposed in front of the main casing to preliminarily brush away the dust or dirt adhered to the surface to be cleaned in front of the drum brush, the subsidiary brush unit having a cover disposed in front of the main casing, and the subsidiary brush unit having a subsidiary brush member to come in elastic contact with the surface to be cleaned, wherein the subsidiary brush member is configured to change a relative position to the cover, and thus to selectively maintain a contact state or a non-contact state to the surface to be cleaned, wherein the subsidiary brush unit further comprises:

a fixing panel to which the subsidiary brush member is connected; and a height adjusting part to move the fixing panel in an up-and-down direction so as to adjust a height of the subsidiary brush member, and wherein the subsidiary brush member is disposed to be rotatable to the fixing panel.

* * * * *